US007754144B2

(12) United States Patent
Brady et al.

(10) Patent No.: US 7,754,144 B2
(45) Date of Patent: Jul. 13, 2010

(54) HIGH NB, TA, AND AL CREEP- AND OXIDATION-RESISTANT AUSTENITIC STAINLESS STEEL

(75) Inventors: Michael P Brady, Oak Ridge, TN (US); Michael L Santella, Knoxville, TN (US); Yukinori Yamamoto, Oak Ridge, TN (US); Chain-tsuan Liu, Oak Ridge, TN (US)

(73) Assignees: UT-Battelle, LLC, Oak Ridge, TN (US); University of Tennessee Research Foundation, Knoxville, TN (US)

( * ) Notice: Subject to any disclaimer, the term of this patent is extended or adjusted under 35 U.S.C. 154(b) by 15 days.

(21) Appl. No.: 12/103,837

(22) Filed: Apr. 16, 2008

(65) Prior Publication Data

US 2008/0304996 A1 Dec. 11, 2008

Related U.S. Application Data

(63) Continuation-in-part of application No. 11/619,944, filed on Jan. 4, 2007.

(51) Int. Cl.

| | |
|---|---|
| ***C22C 38/42*** | (2006.01) |
| ***C22C 38/30*** | (2006.01) |
| ***C22C 38/60*** | (2006.01) |
| ***C22C 38/58*** | (2006.01) |
| ***C22C 38/00*** | (2006.01) |

(52) U.S. Cl. ..... 420/49; 420/38; 420/40; 420/42; 420/45; 420/47; 420/48; 148/326; 148/327

(58) Field of Classification Search ..... None
See application file for complete search history.

(56) References Cited

U.S. PATENT DOCUMENTS 3,839,022 A 10/1974 Webster et al.

(Continued)

FOREIGN PATENT DOCUMENTS

JP 09-324246 * 12/1997

OTHER PUBLICATIONS

Yamamoto, et al., "Alumina-Forming Austenitic Stainless Steels Strengthened by Laves Phase and MC Carbide Precipitates," Metallurgical and Materials Transactions A, 2007.

Brady, et al., Effects of Minor Alloy Additions and Oxidation Temperature on Protective Alumina Scale Formation in Creep-Resistant Austenitic Stainless Steels, Scripta MATERIALIA, 2007, pp. 1117-1120, vol. 57.

*Primary Examiner*—Melvin C Mayes
*Assistant Examiner*—Sarah Van Oudenaren
(74) *Attorney, Agent, or Firm*—Novak Druce + Quigg LLP; Gregory A. Nelson; Gregory M. Lefkowitz

(57) ABSTRACT

An austenitic stainless steel HTUPS alloy includes, in weight percent: 15 to 30 Ni; 10 to 15 Cr; 2 to 5 Al; 0.6 to 5 total of at least one of Nb and Ta; no more than 0.3 of combined Ti+V; up to 3 Mo; up to 3 Co; up to 1 W; up to 0.5 Cu; up to 4 Mn; up to 1 Si; 0.05 to 0.15 C; up to 0.15 B; up to 0.05 P; up to 1 total of at least one of Y, La, Ce, Hf, and Zr; less than 0.05 N; and base Fe, wherein the weight percent Fe is greater than the weight percent Ni wherein said alloy forms an external continuous scale comprising alumina, nanometer scale sized particles distributed throughout the microstructure, said particles comprising at least one composition selected from the group consisting of NbC and TaC, and a stable essentially single phase fcc austenitic matrix microstructure, said austenitic matrix being essentially delta-ferrite-free and essentially BCC-phase-free.

14 Claims, 6 Drawing Sheets

U.S. PATENT DOCUMENTS

| | | | |
|---|---|---|---|
| 3,865,644 | A | 2/1975 | Hellner et al. |
| 4,560,408 | A | 12/1985 | Wilhelmsson |
| 4,576,653 | A | 3/1986 | Ray |
| 4,767,597 | A | 8/1988 | Nishino et al. |
| 4,822,695 | A | 4/1989 | Larson et al. |
| 5,217,684 | A | 6/1993 | Igarashi et al. |
| 5,480,283 | A | 1/1996 | Doi et al. |
| 5,603,891 | A | 2/1997 | Brill |
| 5,618,491 | A | 4/1997 | Kurup et al. |
| 5,945,067 | A | 8/1999 | Hibner et al. |
| 6,004,408 | A | 12/1999 | Montagnon |
| 6,193,145 | B1 | 2/2001 | Fournier et al. |
| 6,352,670 | B1 | 3/2002 | Rakowski |
| 6,372,181 | B1 | 4/2002 | Fahrmann et al. |
| 6,447,716 | B1 | 9/2002 | Cozar et al. |
| 6,866,816 | B2 | 3/2005 | Liang et al. |
| 2004/0060622 | A1 | 4/2004 | Lilley |
| 2004/0191109 | A1 * | 9/2004 | Maziasz et al. ..... 420/45 |
| 2007/0086910 | A1 | 4/2007 | Liang |
| 2007/0217941 | A1 | 9/2007 | Hayashi et al. |

* cited by examiner

HIGH NB, TA, AND AL CREEP- AND OXIDATION-RESISTANT AUSTENITIC STAINLESS STEEL

CROSS-REFERENCE TO RELATED APPLICATIONS

This patent application is a continuation-in-part of U.S. patent application Ser. No. 11/619,944 filed on Jan. 4, 2007 by Michael P. Brady, et al. entitled "Oxidation Resistant High Creep Strength Austenitic Stainless Steel", the entire disclosure of which is incorporated herein by reference.

STATEMENT REGARDING FEDERALLY SPONSORED RESEARCH

The United States Government has rights in this invention pursuant to contract no. DE-AC05-00OR22725 between the United States Department of Energy and UT-Battelle, LLC.

NAMES OF PARTIES TO A JOINT RESEARCH AGREEMENT

None

BACKGROUND OF THE INVENTION

Common austenitic stainless steels contain a maximum by weight percent of 0.15% carbon, a minimum of 16% chromium and sufficient nickel and/or manganese to retain a face-centered-cubic (fcc) austenitic crystal structure at cryogenic temperatures through the melting point of the alloy. Austenitic stainless steels are non-magnetic non-heat-treatable steels that are usually annealed and cold worked. Common austenitic stainless steels are widely used in power generating applications; however, they are becoming increasingly less desirable as the industry moves toward higher thermal efficiencies by increasing the working temperatures of the generators. Austenitic stainless steels for high temperature use rely on $Cr_2O_3$ scales for oxidation protection. These scales grow relatively quickly, and do not function well in environments containing species like water vapor, sulfur, carbon, etc due to inherent limitations of the $Cr_2O_3$ scales formed on these alloys. Creep failure of common austenitic stainless steels such as types 316, 321, and 347 has limited the use of these steels at higher working temperatures.

There have been a number of approaches to improving oxidation resistance of austenitic steels for high temperature use as described in the patent application referenced above.

BRIEF SUMMARY OF THE INVENTION

In accordance with various aspects of the present invention, the foregoing and other objects are achieved by an austenitic stainless steel HTUPS alloy that includes, in weight percent: 15 to 30 Ni; 10 to 15 Cr; 2 to 5 Al; 0.6 to 5 total of at least one of Nb and Ta; no more than 0.3 of combined Ti+V; up to 3 Mo; up to 3 Co; up to 1 W; up to 0.5 Cu; up to 4 Mn; up to 1 Si; 0.05 to 0.15 C; up to 0.15 B; up to 0.05 P; up to 1 total of at least one of Y, La, Ce, Hf, and Zr; less than 0.05 N; and base Fe, wherein the weight percent Fe is greater than the weight percent Ni wherein said alloy forms an external continuous scale comprising alumina, nanometer scale sized particles distributed throughout the microstructure, said particles comprising at least one composition selected from the group consisting of NbC and TaC, and a stable essentially single phase fcc austenitic matrix microstructure, said austenitic matrix being essentially delta-ferrite-free and essentially BCC-phase-free.

Figure 1:
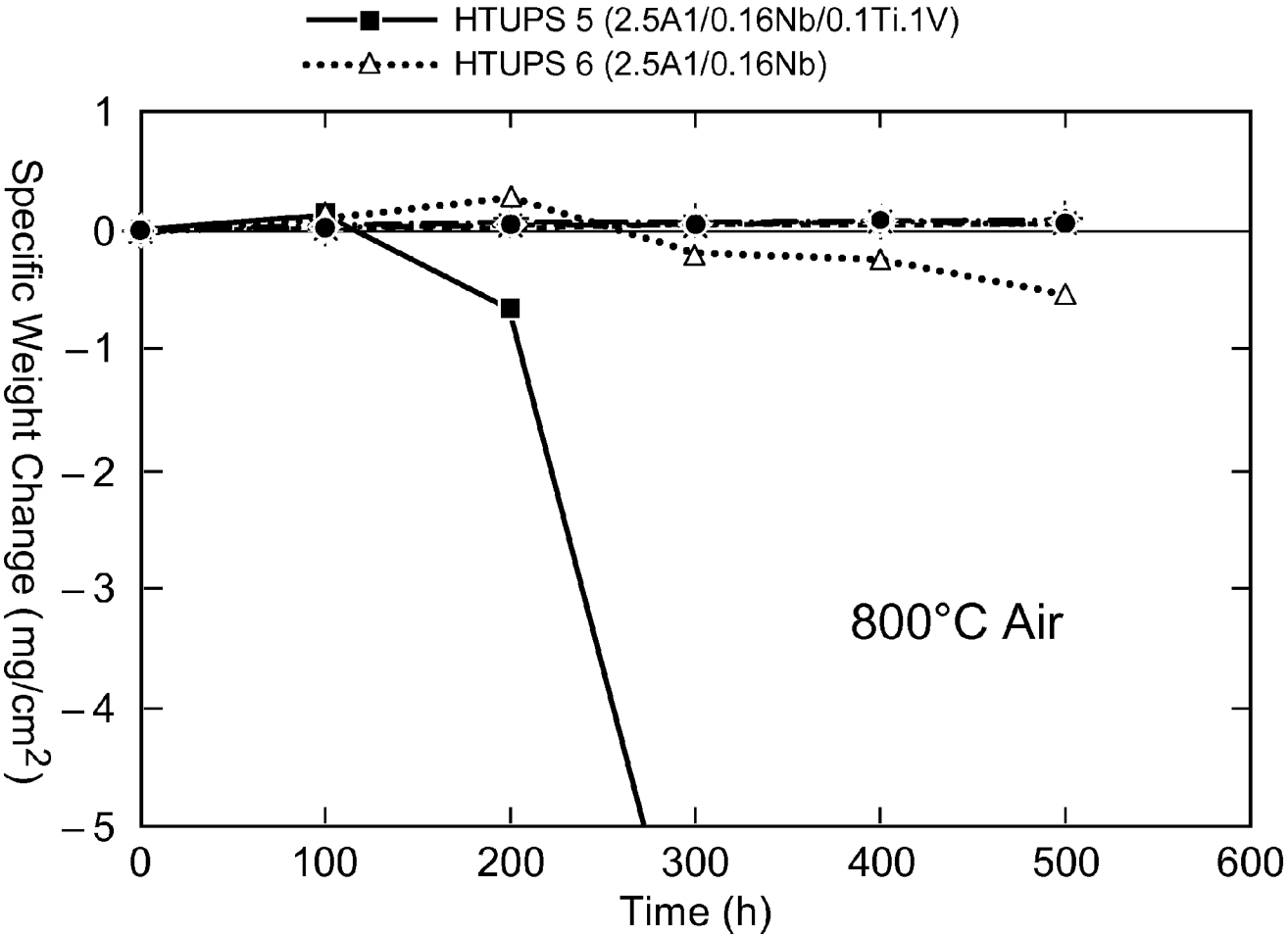
FIG. 1 is a graph showing air oxidation data at 800° C. for various austenitic stainless steel compositions in accordance with the present invention. Data points for alloys HTUPS 4, 7, 10, 11, 12, and FNC 31 cannot be discerned at the mass change scale shown in this figure. That data is provided in FIG. 2.

For a better understanding of the present invention, together with other and further objects, advantages and capabilities thereof, reference is made to the following disclosure and appended claims in connection with the above-described drawings.

DETAILED DESCRIPTION OF THE INVENTION

The present invention is based on the surprising finding that higher Nb levels than that disclosed in the above referenced parent application can improve oxidation resistance. Moreover, higher levels of Al were found to be feasible while still maintaining a single phase austenitic matrix to achieve creep resistance. Higher Al and/or Nb levels should permit greater durability, and even higher operating temperatures. Based on their similar chemical behavior and reactivities, Ta additions can also be used in place of Nb, or in partial combination with Nb, to produce the desired oxidation resistance improvements, and MC carbide type strengthening additions (M=Nb, Ta, Ti, V).

The alloy HTUPS 3, Fe-20 Ni-14 Cr-3.8 Al base showed a two-phase austenitic (face centered cubic (fcc))+delta ferrite (body center cubic (bcc)) structure. The delta ferrite converts to brittle sigma phase when exposed in the intended operation range, and creep resistance is lost. It was therefore decided to limit Al level to 3.5 wt. % to maintain a single phase fcc austenitic structure to obtain creep resistance.

Moreover, HTUPS 4, Fe-20 Ni-14 Cr-2.5 Al base replaced typically used Ti and V strengthening additions with Nb at a level of 0.9 wt. % Nb. The substitution resulted in an excellent combination of creep resistance and alumina scale forming ability, and was based on the unexpected and new discovery that Ti and V additions degrade alumina forming ability in this class of alloys. About 1 wt. % of Nb resulted in $Fe_2Nb$ precipitates, and therefore it was originally thought that increasing Nb>1 wt. % would result in too high a fraction of $Fe_2Nb$, as well as coarse primary NbC, causing brittleness and loss of oxidation resistance.

Two subsequent, surprising discoveries have been made concerning the austenitic stainless steel formulations under investigation:

1) The ability to form alumina is dependent on Nb content, with Nb content less than about 0.6 wt. % Nb severely degrading oxidation resistance. Moreover, increasing Nb content to about 3 wt. % Nb was proven to further improve oxidation resistance, without significantly increasing brittleness despite the increased volume fraction of $Fe_2Nb$ and primary NbC. The 3 Nb wt. % alloy, FNC 31 in below Table I, showed excellent creep rupture elongation (15-20%) despite the presence of $Fe_2Nb$ Laves phase precipitates, and excellent oxidation resistance despite containing only 2.5 wt. % Al. Therefore the upper limit of Nb content is extended to, for example, up to 5 wt. %, up to 4 wt. %, and/or up to 3 wt. %, the lower limit being 0.6 wt. % Nb, preferably greater than 1 wt. % Nb to obtain improved oxidation resistance. At higher levels of Nb, the volume fraction of $Fe_2Nb$ Laves phase would be too great, and adversely compromise the mechanical properties of the alloy.

The effects can also be obtained with Ta instead of Nb, or in combination of Ta with Nb, with the Ta or Ta+Nb content is the same as above: up to 5 wt. %, up to 4 wt. %, and/or up to 3 wt. %. The Ta or Ta+Nb lower limit is also the same as above, about 0.6 wt. %.

2) The ability to maintain alumina scale formation depends on Al content, the higher the Al content the longer alumina scale formation can be maintained, resulting in improved component durability and lifetimes. It was discovered that Al contents to 4 wt. % Al are possible at relatively low levels of Ni to keep alloy cost low (as low as 20 wt. % Ni), by decreasing the Cr level from 14 wt. % range to 12 wt. % Cr range (both Al and Cr stabilize weak bcc phases such as delta ferrite). The presence of Cr is critical to aiding formation of an alumina scale. The reduced level of Cr was found to be sufficient to still aide alumina scale formation, in alloys that remain single phase austenitic matrix for creep resistance. By increasing Ni content to 30 wt. %, it was found possible to further increase Cr content to 14 wt. %, at 4 wt. % Al, while maintaining a single-phase austenitic matrix microstructure (AFA 13). At 30 wt. % Ni and 12 wt. % Cr (AFA 14), single-phase austenitic matrix microstructure could also be obtained at 5 wt. % Al.

The higher levels of Al, for example, up to 4 wt. %, up to 4.5 wt. % and/or up to 5 wt. %, result in increased volume fraction of NiAl second phase precipitates, which help maintain alumina scale formation by acting as an Al reservoir. Thermochemical calculations indicate that the 4 Al-12 Cr alloys can also tolerate the increase to at least 3 wt. % Nb (and/or Ta), without forming weak bcc phases.

Table I discloses some experimentally produced alloy compositions in accordance with the present invention. Nominal alloy compositions include (balance Fe). Compositions AFA 3 and AFA 9 also contain 0.07 Y and 0.15 Hf wt. %. Composition AFA 8 also contains 0.2 wt. % Zr. Based on their similar chemical behavior and reactivities, Ta additions can also be used in place of Nb in the alloys shown in Table I, or in partial combination with Nb, to produce the desired oxidation resistance improvements.

(Table 1 is on next page)

TABLE I

| | Composition wt. % | | | | | | | | | | | | | |
|---|---|---|---|---|---|---|---|---|---|---|---|---|---|---|
| Alloy | Ni | Cr | Al | Nb | Ti | V | Mo | W | Cu | Mn | Si | C | B | P |
| HTUPS 3 | 20 | 14.3 | 3.8 | 0.15 | 0.5 | 0.3 | 2.5 | | | 2 | 0.15 | 0.08 | 0.01 | 0.04 |
| HTUPS 4 | 20 | 14.3 | 2.5 | 0.9 | | | 2.5 | | | 2 | 0.15 | 0.08 | 0.01 | 0.04 |
| HTUPS 5 | 20 | 14.3 | 2.5 | 0.16 | 0.1 | 0.1 | 2.5 | | | 2 | 0.15 | 0.08 | 0.01 | 0.04 |
| HTUPS 6 | 20 | 14.3 | 2.5 | 0.16 | | | 2.5 | | | 2 | 0.15 | 0.08 | 0.01 | 0.04 |
| HTUPS 7 | 20 | 14.3 | 3 | 0.4 | 0.1 | | 2 | 1 | 0.5 | 2 | 0.15 | 0.08 | 0.01 | 0.04 |
| HTUPS 8 | 20 | 14.3 | 3 | 0.6 | 0.1 | | 2 | 1 | 0.5 | 2 | 0.15 | 0.1 | 0.01 | 0.04 |
| HTUPS 9 | 15 | 12 | 3 | 0.6 | | | | | 3 | 2 | 0.7 | 0.1 | 0.01 | |
| HTUPS 10 | 20 | 14.3 | 3 | 1.5 | 0.1 | | 2 | 1 | 0.5 | 2 | 0.15 | 0.1 | 0.01 | 0.04 |
| HTUPS 11 | 20 | 14.3 | 3 | 2.5 | 0.1 | | 2 | 1 | 0.5 | 2 | 0.15 | 0.1 | 0.01 | 0.04 |
| HTUPS 12 | 20 | 12 | 4 | 0.6 | 0.1 | | 2 | 1 | 0.5 | 2 | 0.15 | 0.1 | 0.01 | 0.04 |
| FNC 31 | 21 | 14 | 2.5 | 3 | | 0.18 | 3 | | | | | 0.02 | 0.02 | |
| FNC 28 | 21 | 14 | 2.5 | 1.7 | 0.3 | | 1.6 | | | | | 0.04 | 0.01 | |
| FNC 27 | 21 | 14 | 2.5 | 1.7 | | 0.5 | 1.6 | | | | | 0.04 | 0.01 | |
| FNC 26 | 21 | 14 | 2.5 | 1.7 | 0.3 | 0.5 | 1.6 | | | | | 0.04 | 0.01 | |
| FNC 25 | 21 | 14 | 2.5 | 1.7 | | | 1.6 | | | | | 0.04 | 0.01 | 0.04 |
| FNC35 | 26 | 14 | 3 | 0.6 | | | 1.25 | | | 0.2 | 0.2 | 0.04 | 0.01 | 0.015 |
| AFA1 | 20 | 14.3 | 3 | 1 | | | 2 | 1 | 0.5 | 2 | 0.15 | 0.1 | 0.01 | 0.02 |
| AFA2 | 20 | 14.3 | 3 | 1 | | 0.2 | 2 | 1 | 0.5 | 2 | 0.15 | 0.1 | 0.01 | 0.02 |
| AFA3 | 20 | 14.3 | 3 | 1 | | | 2 | 1 | 0.5 | 2 | 0.15 | 0.1 | 0.01 | 0.02 |
| AFA4 | 25 | 14.3 | 3 | 1 | | 0.2 | 2 | 1 | 0.5 | 2 | 0.15 | 0.1 | 0.01 | 0.02 |
| AFA5 | 20 | 12 | 4 | 1 | | | 2 | 1 | 0.5 | 2 | 0.15 | 0.1 | 0.01 | 0.02 |
| AFA6 | 25 | 12 | 4 | 1 | | | 2 | 1 | 0.5 | 2 | 0.15 | 0.1 | 0.01 | 0.02 |
| AFA7 | 25 | 12 | 4 | 1 | | 0.2 | 2 | 1 | 0.5 | 2 | 0.15 | 0.1 | 0.01 | 0.02 |

TABLE I-continued

| | Composition wt. % | | | | | | | | | | | | | |
|---|---|---|---|---|---|---|---|---|---|---|---|---|---|---|
| Alloy | Ni | Cr | Al | Nb | Ti | V | Mo | W | Cu | Mn | Si | C | B | P |
| AFA8 | 25 | 12 | 4 | 1 | | 0.2 | 2 | 1 | 0.5 | 2 | 0.15 | 0.1 | 0.01 | 0.02 |
| AFA9 | 25 | 12 | 4 | 1 | | | 2 | 1 | 0.5 | 2 | 0.15 | 0.1 | 0.01 | 0.02 |
| AFA10 | 30 | 14 | 3 | 0.6 | | | 1.25 | | | 0.2 | 0.2 | 0.04 | 0.006 | 0.02 |
| AFA 13 | 30 | 14 | 4 | 1 | | | 2 | | | | | 0.1 | | |
| AFA 14 | 30 | 12 | 5 | 1 | | | 2 | | | | | 0.1 | | |

FIG. 1 shows for cyclic oxidation at 800° C. in air that reducing Nb level to 0.16 wt. % Nb (HTUPS 5), from the original HTUPS 4 level of 0.9 wt. % Nb, degraded oxidation resistance, with oxide scale spallation and weight loss resulting from formation of less-protective Fe—Cr base oxides, rather than continuous alumina scale. Additions of even small levels of Ti and V (HTUPS 6 with 0.16Nb, 0.1V and 0.1 Ti) result in a further, drastic degradation in oxidation resistance.

Figure 2:
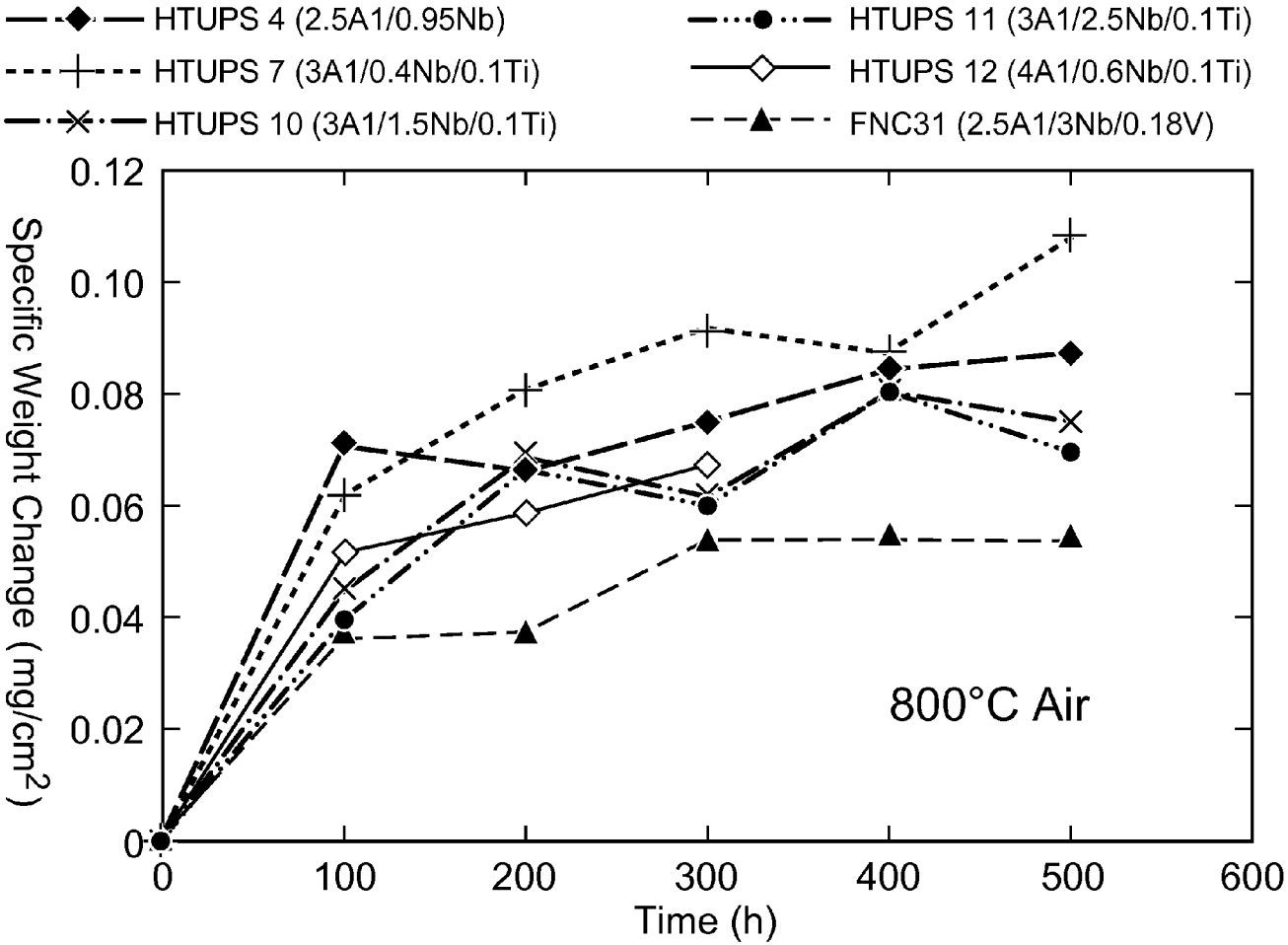
FIG. 2 is a graph showing air oxidation data at 800° C. for various austenitic stainless steel compositions in accordance with the present invention.

FIG. 2 is a magnification of FIG. 1 in the low, positive weight change regime. The mass uptake of the alloys HTUPS 4, HTUPS 7, HTUPS 10, HTUPS 11, and FNC 31 scale inversely with Nb content, with FNC 31 containing 3 wt. % Nb exhibiting the greatest degree of oxidation resistance (lowest mass uptake) among these compositions. Also shown is data for HTUPS 12, which contains 4 wt. % Al but only 0.6 wt. % Nb. Despite the significantly higher level of Al than FNC 31 (4 wt. % Al vs 2.5 wt. % Al), HTUPS 12 showed slightly higher (albeit acceptable) mass gains than FNC 31, further highlighting the importance of high Nb content.

Figure 3:
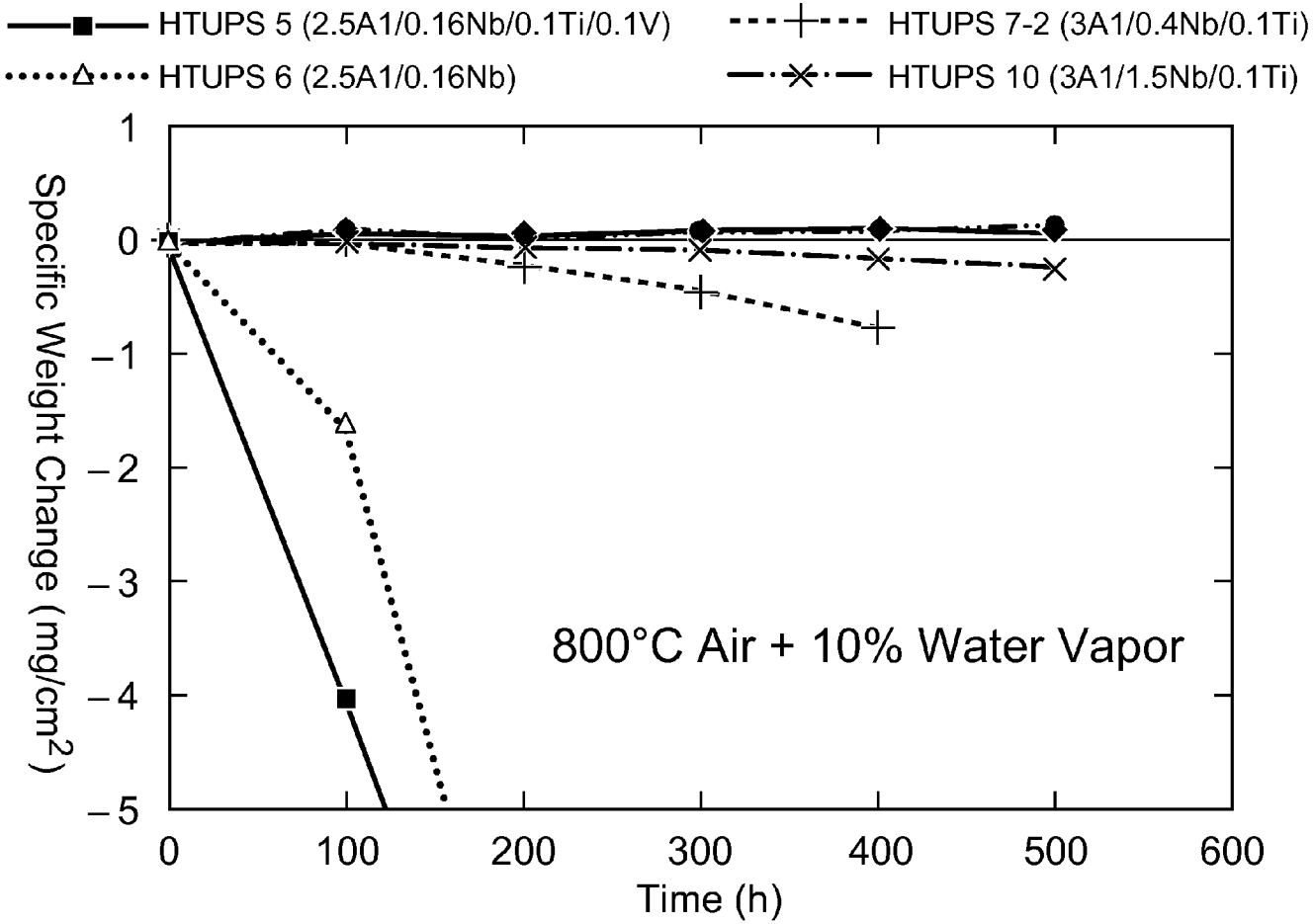
FIG. 3 is a graph showing air+10% water vapor oxidation data at 800° C. for various austenitic stainless steel compositions in accordance with the present invention. Data points for alloys HTUPS 4, 11, 12, and FNC 31 cannot be discerned at the mass change scale shown in this figure. That data is provided in FIG. 4.

FIG. 3 shows oxidation behavior of the alloys under more aggressive conditions of air with 10% water vapor at 800° C. HTUPS 5 and 6 suffer from very poor oxidation resistance resulting from Fe—Cr rich oxide scale formation, rather than external alumina, and extensive scale spallation and mass loss. Under these more aggressive conditions, HTUPS 7, with 0.4Nb and 0.1Ti, and HTUPS 10, with 1.5Nb and 0.1Ti, also show susceptibility to scale spallation and mass loss, although not to the degree of HTUPS 5 and 6.

Figure 4:
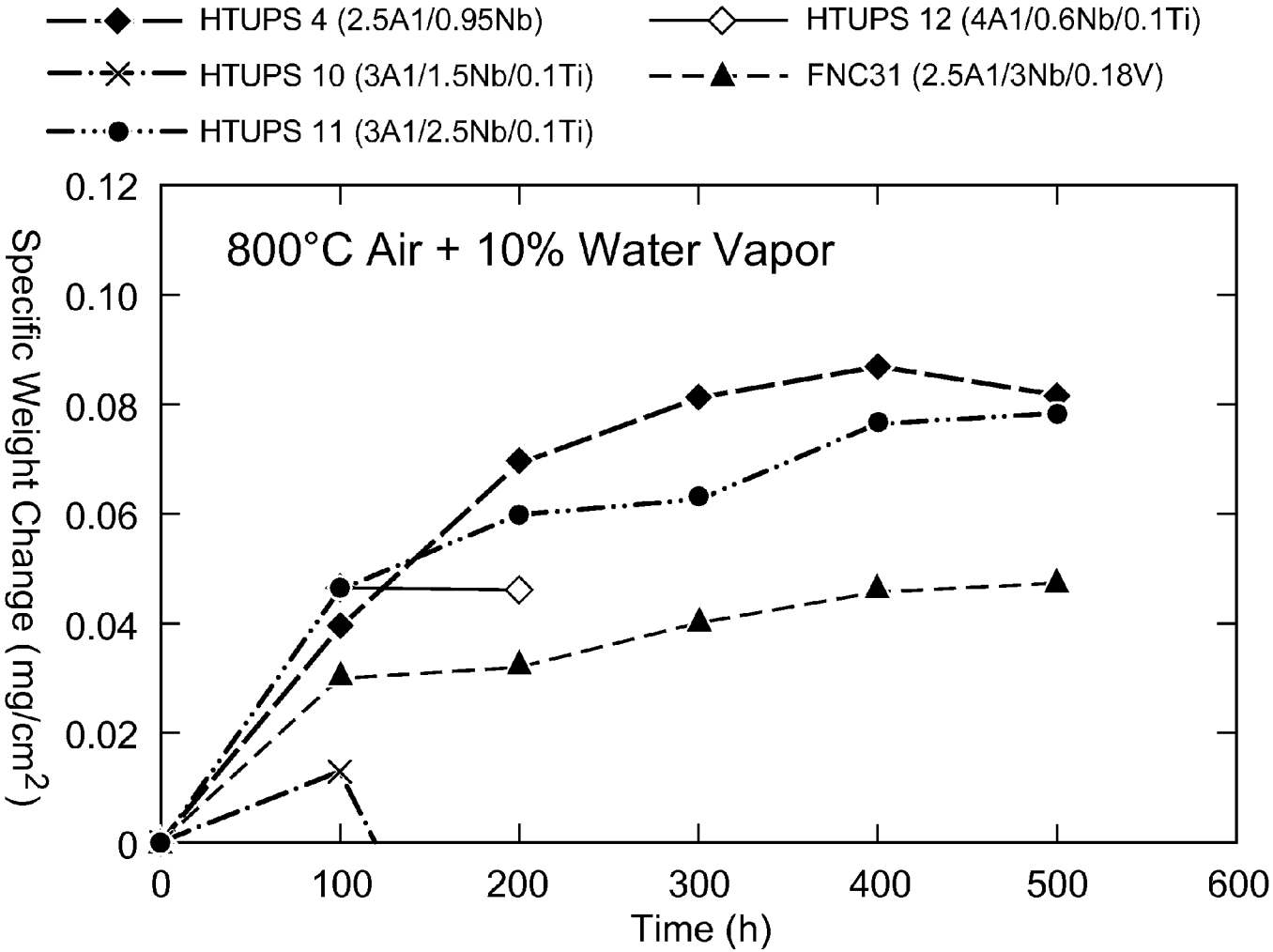
FIG. 4 is a graph showing air+10% water vapor oxidation data at 800° C. for various austenitic stainless steel compositions in accordance with the present invention.

FIG. 4 is a magnification of FIG. 3 in the low, positive weight change regime. Increasing the Nb level above the originally claimed upper limit of 1 wt. % Nb resulted in excellent oxidation resistance (HTUPS 11, and FNC 31), and it was generally improved over that of the baseline HTUPS 4. Again, the best behavior was exhibited by FNC 31, which contained the lowest amount of Al, 2.5 wt. %, but the highest tested amount of Nb, 3 wt. %. Despite the higher Al and Nb content, HTUPS 10 was less oxidation resistant than HTUPS 4. This is attributed to the 0.1 wt. % Ti addition to HTUPS 10. Increasing the Nb level from that of HTUPS 10 (1.5 wt. % Nb) to HTUPS 11 (2.5 wt. % Nb) increased tolerance for the 0.1 Ti addition and resulted in excellent oxidation resistance under these conditions.

Figure 5:
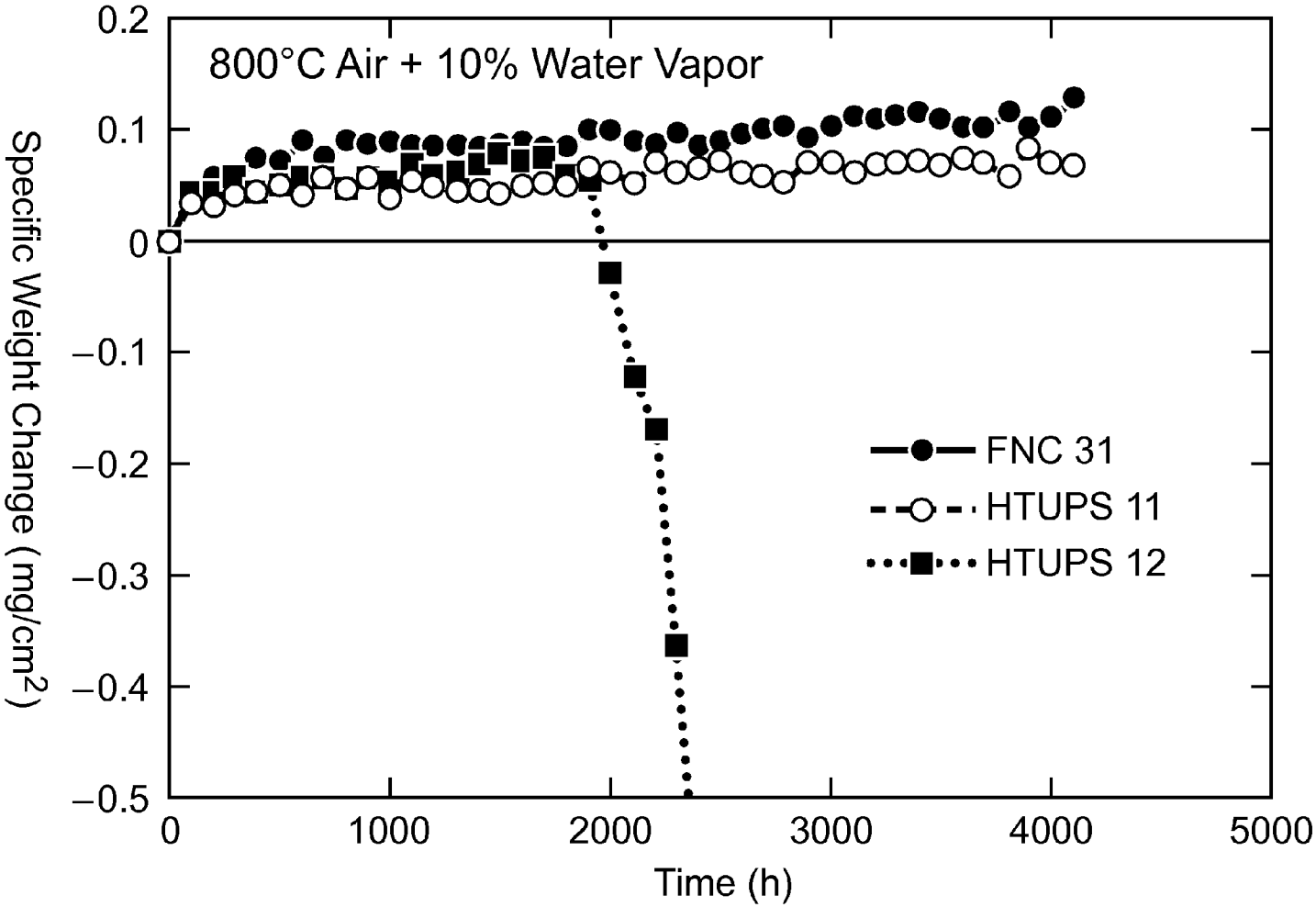
FIG. 5 is a graph showing air+10% water vapor oxidation data at 800° C. for various austenitic stainless steel compositions in accordance with the present invention.

Data for HTUPS 12 (4 Al and 0.6 Nb) is also shown. As with the trends observed in air, HTUPS 12 exhibited good oxidation resistance over the course of the exposure shown in FIG. 4, due to the high 4 wt. % level of Al addition, but was not as resistant as was FNC 31, which contained high Nb but only 2.5 wt. % Al. FNC 31 and HTUPS 11 have maintained this excellent oxidation resistance in air with 10% water vapor to 4000 h of total exposure as shown in FIG. 5, where as HTUPS 12 shows degradation in oxidation resistance at around 2000 h of exposure under these highly aggressive conditions, due to its low Nb content.

It was also found that high levels of Nb also improved the ability of the alloys to tolerate small additions of Ti or V. For example, FNC 31 contained 2.5Al/3Nb/0.2V but was highly oxidation resistant, even in water vapor. AFA 2 and AFA 4 3Al/1Nb/0.2V exhibited nodule formation and accelerated attack at 800° C. in water vapor. Such accelerated attack was not observed for AFA 7 and AFA 8, which contained 25 wt. % Ni and 4 wt. % Al, instead of 20 wt. % Ni and 3 wt. % Al in AFA 2 and 4.

Figure 6:
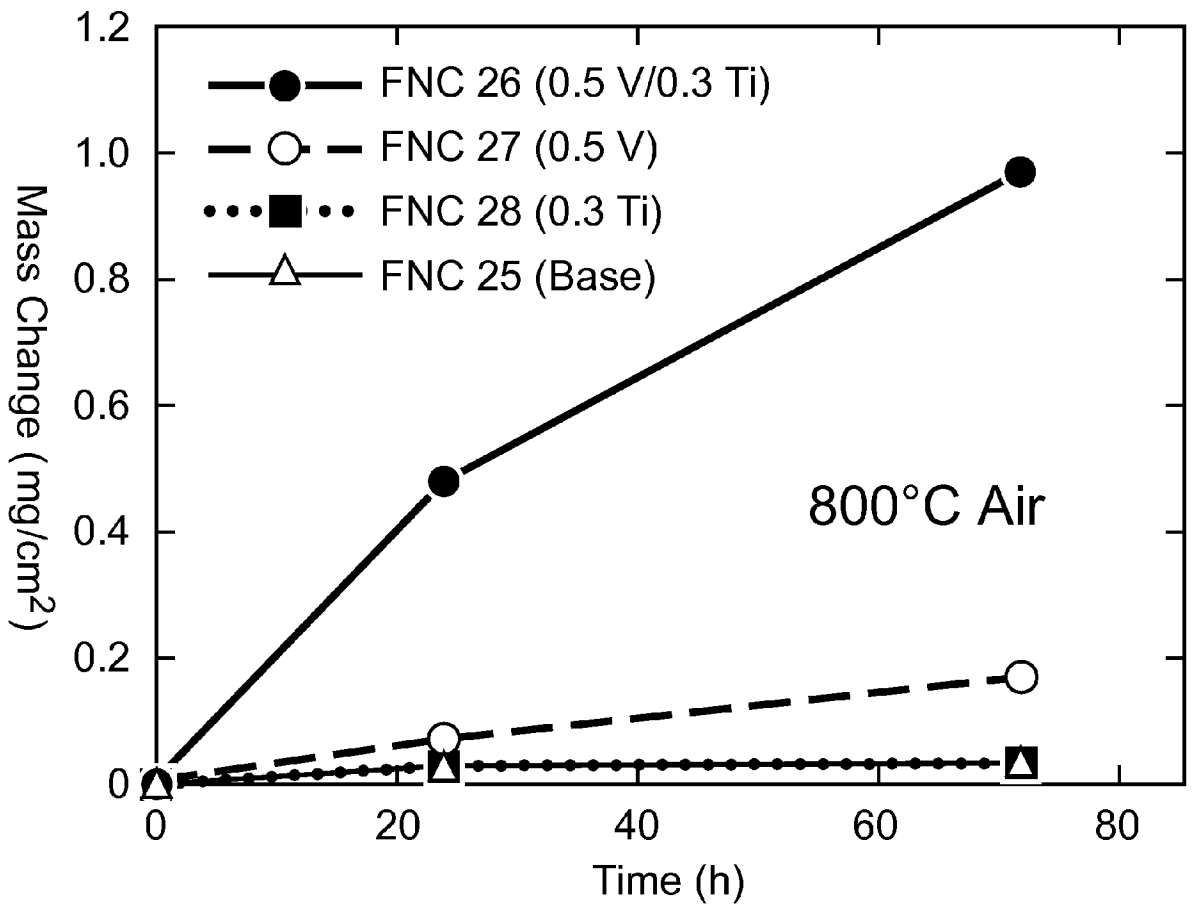
FIG. 6 is a graph showing air oxidation data at 800° C. for various austenitic stainless steel compositions in accordance with the present invention.

Small additions of Ti and V can be used to further enhanced creep resistance, but are still limited to no more than about 0.3 wt. % total, preferably with only Ti or V, not both added, particularly when the Nb level is between 1 and 3 wt. % Nb. The "synergistic" degradation in oxidation resistance by combined Ti and V additions is shown below in FIG. 6. FNC 28 with 1.7Nb and 0.3Ti exhibit comparable oxidation behavior to that of FNC 25 baseline alloy with 1.7Nb. FNC 27 with 1.7 Nb and 0.5 V shows a degradation in oxidation resistance, and FNC 26 with 1.7Nb and 0.5V, 0.3Ti shows a loss of alumina scale forming ability.

The ability of the alloys to form a protective alumina scale is degraded with increasing oxidation temperature. Alloys with 20 wt. % Ni, despite their Al and Nb contents, lose the ability to form a protective alumina scale between approximately 800 and 900° C. in air. The alloys with compositions equal to or greater than 25 wt. % Ni, 1 wt. % Nb, and 3 wt. % Al show the ability to form protective alumina scales up to around 900° C. in air. Alloys AFA 13 and 14, with 30 wt. % Ni and 4 to wt. % Al show somewhat improved oxidation resistance and alumina forming ability up to about 1000° C.

While there has been shown and described what are at present considered the preferred embodiments of the invention, it will be obvious to those skilled in the art that various changes and modifications can be prepared therein without departing from the scope of the inventions defined by the appended claims.

We claim:

1. An austenitic stainless steel HTUPS alloy consisting essentially of, in weight percent:

15 to 30 Ni;
10 to 15 Cr;
greater than 3.5, up to 5 Al;
0.6 to 1 total of at least one element selected from the group consisting of Nb and Ta;
no more than 0.3 of combined Ti+V;
up to 3 Mo;
up to 3 Co;
up to 1 W;
up to 0.5 Cu;
up to 4 Mn;
up to 1 Si;
0.05 to 0.15 C;
up to 0.15 B;
up to 0.05 P;

up to 1 total of at least one element selected from the group consisting of Y, La, Ce, Hf, and Zr;

less than 0.05 N; and base Fe, wherein the weight percent Fe is greater than the weight percent Ni wherein said alloy forms an external continuous scale comprising alumina, nanometer scale sized particles distributed throughout the microstructure, said particles comprising at least one composition selected from the group consisting of NbC and TaC, and a stable essentially single phase fcc austenitic matrix microstructure, said austenitic matrix being essentially delta-ferrite-free and essentially BCC-phase-free.

2. An austenitic stainless steel HTUPS alloy in accordance with claim 1 wherein the Al content is limited to no more than 4.5 wt. %.

3. An austenitic stainless steel HTUPS alloy in accordance with claim 2 wherein the Al content is limited to no more than 4 wt. %.

4. An austenitic stainless steel HTUPS alloy in accordance with claim 1, wherein a mass gain of said alloy over 500 hours of exposure at 800 C in air and 10 vol-% $H_2O$ is a positive value less than 0.2 mg/cm$^2$.

5. An austenitic stainless steel HTUPS alloy consisting essentially of, in weight percent:

15 to 30 Ni;

10 to 15 Cr;

2 to 3.5 Al;

greater than 1, up to 5 total of at least one element selected from the group consisting of Nb and Ta;

no more than 0.3 of combined Ti+V;

up to 3 Mo;

up to 3 Co;

up to 1 W;

up to 0.5 Cu;

up to 4 Mn;

up to 1 Si;

0.05 to 0.15 C;

up to 0.15 B;

up to 0.05 P;

up to 1 total of at least one element selected from the group consisting of Y, La, Ce, Hf, and Zr;

less than 0.05 N; and base Fe, wherein the weight percent Fe is greater than the weight percent Ni wherein said alloy forms an external continuous scale comprising alumina, nanometer scale sized particles distributed throughout the microstructure, said particles comprising at least one composition selected from the group consisting of NbC and TaC, and a stable essentially single phase fcc austenitic matrix microstructure, said austenitic matrix being essentially delta-ferrite-free and essentially BCC-phase-free.

6. An austenitic stainless steel HTUPS alloy in accordance with claim 5 wherein the total of at least one element selected from the group consisting of Nb and Ta is limited to no more than 4 wt. %.

7. An austenitic stainless steel HTUPS alloy in accordance with claim 6 wherein the total of at least one element selected from the group consisting of Nb and Ta is limited to no more than 3 wt. %.

8. An austenitic stainless steel HTUPS alloy in accordance with claim 5, wherein a mass gain of said alloy over 500 hours of exposure at 800 C in air and 10 vol-% $H_2O$ is a positive value less than 0.2 mg/cm$^2$.

9. An austenitic stainless steel HTUPS alloy consisting essentially of, in weight percent:

15 to 30 Ni;

10 to 15 Cr;

greater than 3.5, up to 5 Al;

greater than 1, up to 5 total of at least one element selected from the group consisting of Nb and Ta;

no more than 0.3 of combined Ti+V;

up to 3 Mo;

up to 3 Co;

up to 1 W;

up to 0.5 Cu;

up to 4 Mn;

up to 1 Si;

0.05 to 0.15 C;

up to 0.15 B;

up to 0.05 P;

up to 1 total of at least one element selected from the group consisting of Y, La, Ce, Hf, and Zr;

less than 0.05 N; and base Fe, wherein the weight percent Fe is greater than the weight percent Ni wherein said alloy forms an external continuous scale comprising alumina, nanometer scale sized particles distributed throughout the microstructure, said particles comprising at least one composition selected from the group consisting of NbC and TaC, and a stable essentially single phase fcc austenitic matrix microstructure, said austenitic matrix being essentially delta-ferrite-free and essentially BCC-phase-free.

10. An austenitic stainless steel HTUPS alloy in accordance with claim 9 wherein the Al content is limited to no more than 4.5 wt. %.

11. An austenitic stainless steel HTUPS alloy in accordance with claim 10 wherein the Al content is limited to no more than 4 wt. %.

12. An austenitic stainless steel HTUPS alloy in accordance with claim 9 wherein the total of at least one element selected from the group consisting of Nb and Ta is limited to no more than 4 wt. %.

13. An austenitic stainless steel HTUPS alloy in accordance with claim 12 wherein the total of at least one element selected from the group consisting of Nb and Ta is limited to no more than 3 wt. %.

14. An austenitic stainless steel HTUPS alloy in accordance with claim 9, wherein a mass gain of said alloy over 500 hours of exposure at 800 C in air and 10 vol-% $H_2O$ is a positive value less than 0.2 mg/cm$^2$.

* * * * *